US007671264B1

(12) United States Patent
Heda

(10) Patent No.: US 7,671,264 B1
(45) Date of Patent: Mar. 2, 2010

(54) PROTECTIVE COVER FOR A GUITAR

(76) Inventor: Howard J. Heda, 2675 Rolling Hills Dr., Monroe, NC (US) 28110

( * ) Notice: Subject to any disclaimer, the term of this patent is extended or adjusted under 35 U.S.C. 154(b) by 0 days.

(21) Appl. No.: 12/322,835

(22) Filed: Feb. 6, 2009

(51) Int. Cl.
*G10G 3/00* (2006.01)

(52) U.S. Cl. ..... 84/453; 4/327

(58) Field of Classification Search ..... 84/453, 84/327, 329
See application file for complete search history.

(56) References Cited

U.S. PATENT DOCUMENTS

| | | | | |
|---|---|---|---|---|
| 4,000,678 | A | | 1/1977 | Messina |
| 4,177,847 | A | | 12/1979 | Spindler |
| D278,442 | S | | 4/1985 | Whomsley |
| D285,700 | S | | 9/1986 | White |
| D315,167 | S | * | 3/1991 | Willis ..... D17/20 |
| D320,405 | S | * | 10/1991 | Wyant ..... D17/20 |
| 5,725,094 | A | | 3/1998 | Moral |
| 6,054,642 | A | | 4/2000 | Brooks |
| 7,453,034 | B2 | | 11/2008 | Johnson |
| 7,462,769 | B2 | | 12/2008 | Kilpatrick |
| 2005/0257664 | A1 | * | 11/2005 | Kessler ..... 84/453 |

* cited by examiner

*Primary Examiner*—Kimberly R Lockett
(74) *Attorney, Agent, or Firm*—P. Jeff Martin; The McGougan Law Firm, LLC

(57) ABSTRACT

A lightweight, portable, flexible protective cover for a guitar is disclosed. Upon placement of the cover in an operative position onto the guitar, the protective cover is adapted to provide unobstructed access to and use of the functional control elements of the guitar during the playing thereof.

9 Claims, 4 Drawing Sheets

PROTECTIVE COVER FOR A GUITAR

RELATED APPLICATIONS

There are no previously filed, nor currently any co-pending applications, anywhere in the world.

BACKGROUND OF THE INVENTION

1. Field of the Invention

This application discloses and claims embodiments generally related to protective covers, and more particularly, to a protective cover for a guitar.

2. Description of the Related Art

It is well known that guitars, and especially electric guitars because of the exuberant manner in which they are played, are prone to scratches, dents, chips, and dings from accidental contact with objects during use. Electric guitars are also subject to marring and other damage from general wear caused by friction from the player's hand, belt buckles, zippers, buttons and other hard or abrasive items on the player's person.

The prior art discloses various covers for stringed musical instruments, however, they are not lightweight, easily transported, and do not allow the player complete and unobstructed access to and use of the guitar's functional control elements, such as control knobs and guitar strings, during the playing of the instrument.

The art does not appear to disclose the combination of features disclosed herein, specifically, a lightweight, collapsible, portable, protective cover for a guitar which provides unobstructed access to and use of the control knobs, guitar strings, and the like during the playing of the instrument.

Accordingly, a need has arisen for a lightweight, portable, collapsible, and foldable, protective cover for a guitar. The development of the protective cover for a guitar fulfills this need.

A search of the prior art did not disclose any patents that read directly on the claims of the instant invention; however, the following references were considered related.

U.S. Pat. No. 6,054,642, issued in the name of Brooks;

U.S. Pat. No. 5,725,094, issued in the name of Moral;

U.S. Pat. No. 7,453,034 B2, issued in the name of Johnson;

U.S. Pat. No. D315,167, issued in the name of Willis;

U.S. Pat. No. D285,700, issued in the name of White;

U.S. Pat. No. 7,462,769 B2, issued in the name of Kilpatrick;

U.S. Pat. No. 4,000,678, issued in the name of Messina;

U.S. Pat. No. D278,442, issued in the name of Whomsley;

U.S. Pat. No. D320,405, issued in the name of Wyant; and

U.S. Pat. No. 4,177,847, issued in the name of Spindler.

Consequently, a need has been felt for protective cover for a guitar which provides unobstructed access to and use of the functional control elements thereof, such as control knobs, guitar strings, and the like during the playing of the instrument. This application presents claims and embodiments that fulfill a need or needs not yet satisfied by the products, inventions and methods previously or presently available. In particular, the claims and embodiments disclosed herein describe a lightweight, portable, and foldable protective cover for a guitar, the cover providing unanticipated and nonobvious combination of features distinguished from the products, inventions and methods preexisting in the art. The applicant is unaware of any product, method, disclosure or reference that discloses the features of the claims and embodiments disclosed herein.

SUMMARY OF THE INVENTION

Therefore, it is an object of the present invention to provide a protective cover for a guitar which provides unobstructed access to and use of the control knobs, guitar strings, and the like during the playing of the instrument.

It is another object of the present invention to provide a protective cover for a guitar comprising a flexible, stretchable, and returnably-resilient body adapted to form fit to the contours of the body of the guitar.

It is still another object of the present invention to provide a protective cover for a guitar being easily foldable to a small volume, thereby facilitating compact storage and transport.

It is yet another object of the present invention to provide a fastener adapted to aid in securely holding the protective cover onto the guitar.

In accordance with one embodiment of the present invention, a protective cover for a guitar is disclosed for protecting the body of a guitar of the type having an upper fin and a lower fin. The protective cover comprises a flexible body adapted to form fit to the contours of the body of the guitar. The protective cover easily foldable to a small volume, thereby facilitating compact storage and transport.

The body of the cover comprises an anterior region opposite a posterior region, and a central region located therebetween. The body further comprises a generally U-shaped configuration and includes a first fin member and a second fin member formed at the anterior region of body. The body includes an arcuate-shaped neck integrally bridging the first fin member and second fin member. The body tapers inward from a greater transverse width at anterior region to a smaller transverse width at central region forming first and second concave portions of central region, and terminating to a greater transverse width defining a pair of curved edge members at the posterior region.

The body of the cover is connected to a peripheral side member having an elasticized bottom edge adapted to allow the protective cover to form fit to the contours of the guitar body in an intimate, taut manner.

An aperture or circular slit is formed in both the first fin member of the body of cover and the peripheral side member at posterior region of the body of cover to receive the strap buttons, respectively, of guitar body.

The body of the cover further comprises a fastener adapted to aid in securely holding the protective cover onto the guitar. When the protective cover is slipped operatively onto and protecting the guitar body, the fastener is designed, configured, and fastened such that the fastener is physically isolated from contact with the guitar strings and control knobs, thereby providing a guitar player with unobstructed access to and use of the control knobs and guitar strings during the playing of the guitar.

The use of the present invention provides protection to the body of a guitar while simultaneously allowing a guitar player with unobstructed access to and use of the control knobs, guitar strings, and the like during the playing of the instrument.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
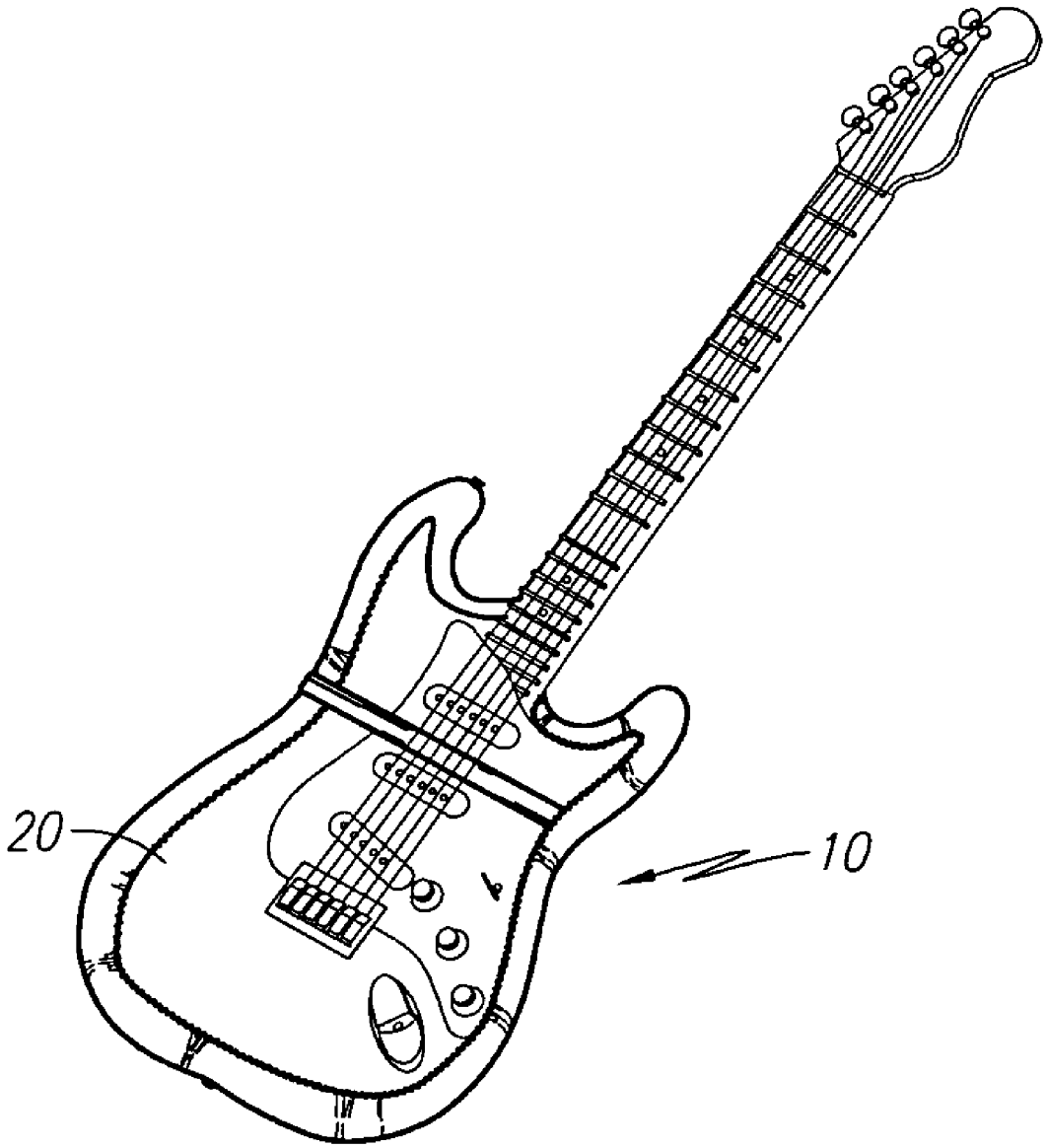
FIG. 1 is a front perspective view of the protective cover shown in a stretched, operative position over the guitar body.
Figure 2:
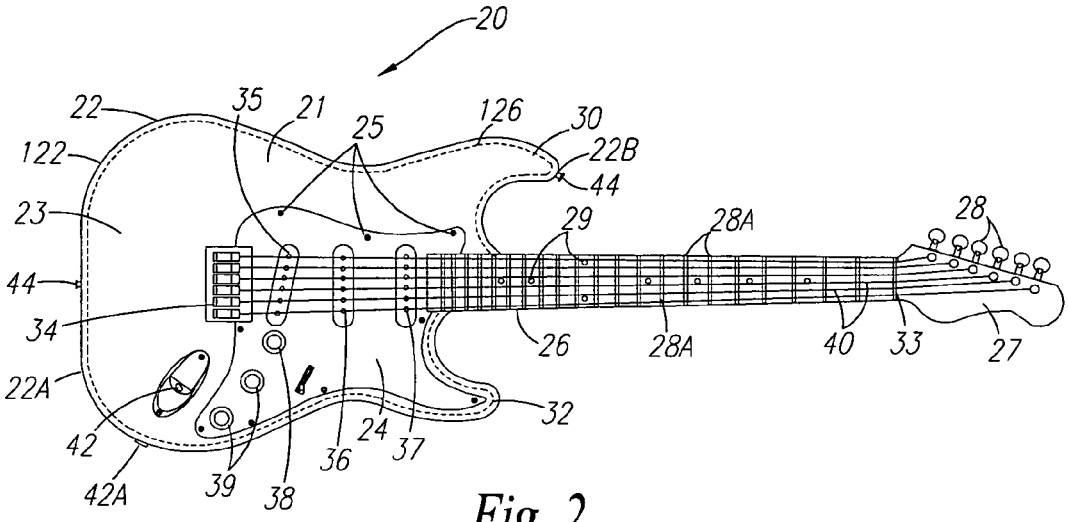
Fig. 2 (Prior Art)
FIG. 2, labeled as "Prior Art", illustrates a front perspective view of an electric guitar.
Figure 3:
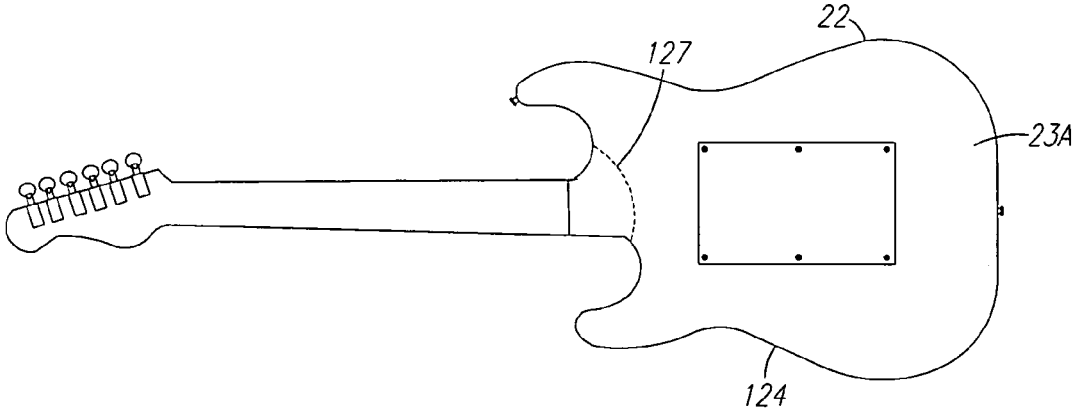
Fig. 3 (Prior Art)
FIG. 3, labeled as "Prior Art", illustrates a bottom plan view of the electric guitar of FIG. 2.
Figure 4:
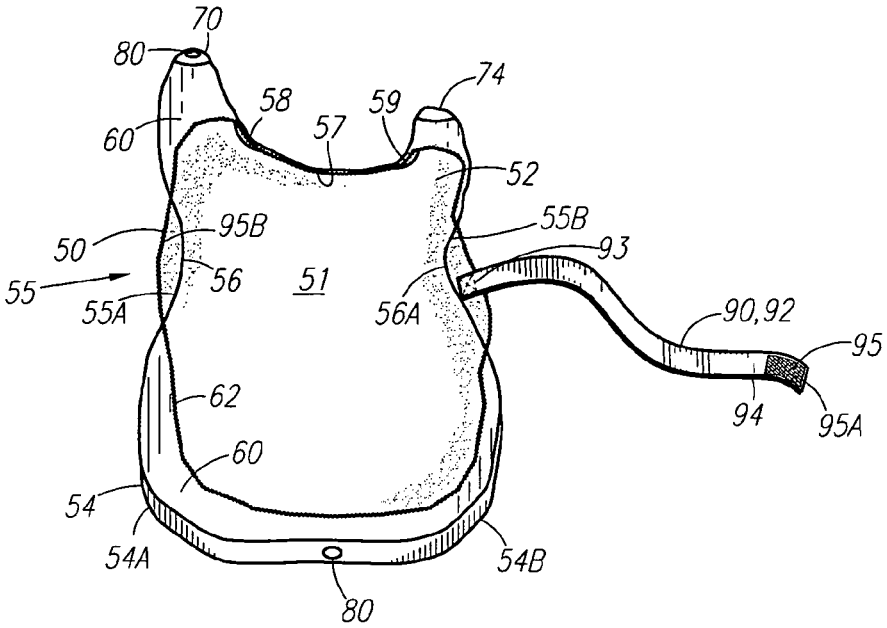
FIG. 4 is a top plan view of the protective cover shown in a relaxed, non-stretched configuration, according to the preferred embodiment of the present invention.
Figure 5:
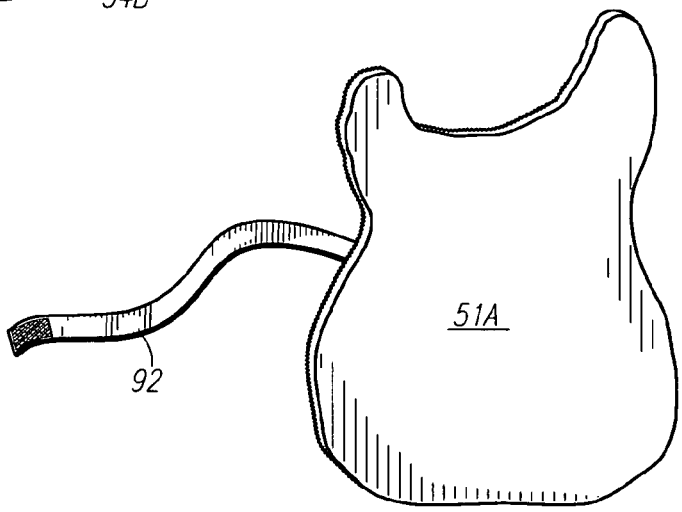
FIG. 5 is a bottom plan view of the protective cover of FIG. 4, according to the preferred embodiment of the present invention.
Figure 6:
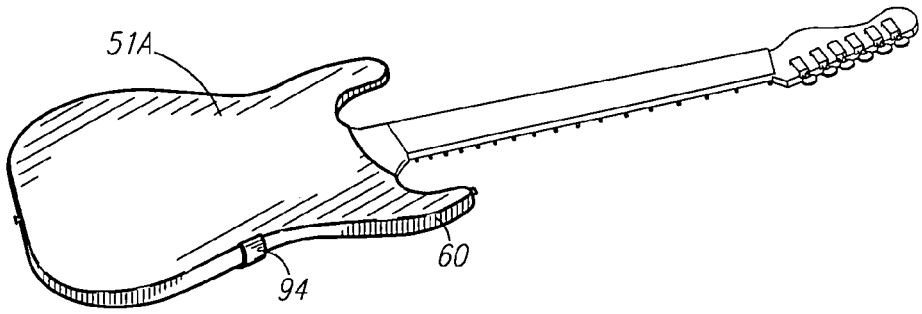
FIG. 6 is a right perspective view of the cover of FIG. 1 illustrating removable attachment by fastener to the peripheral side member, according to the preferred embodiment of the present invention.
Figure 7:
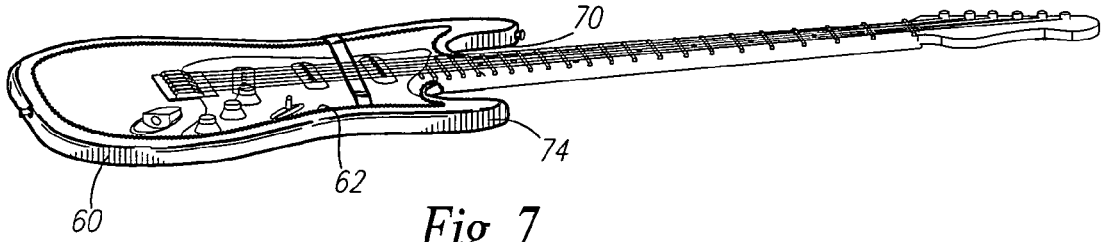
FIG. 7 is a left perspective view of the cover of FIG. 1, according to the preferred embodiment of the present invention.
Figure 8:
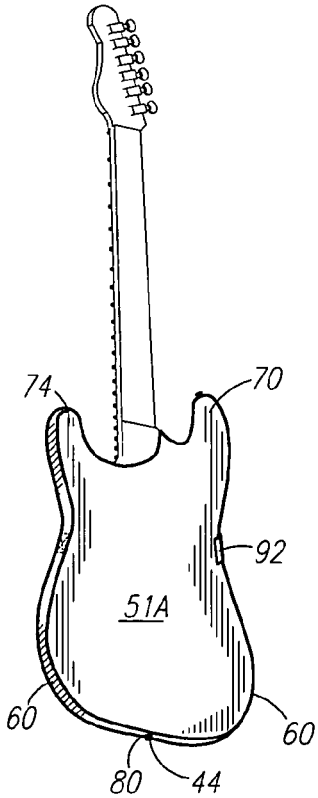
FIG. 8 is a rear perspective view of the cover of FIG. 1, according to the preferred embodiment of the present invention.
Figure 9:
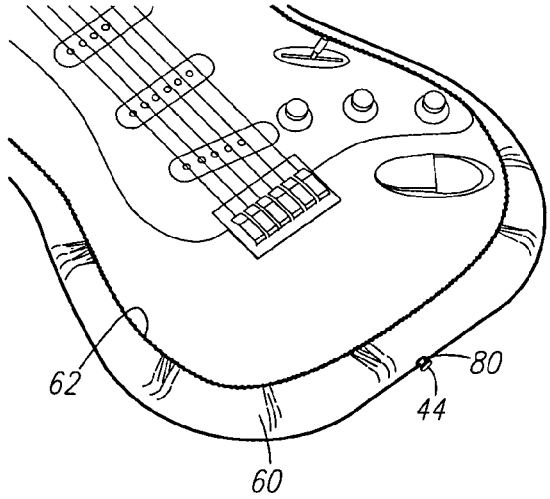
FIG. 9 is a partial lower end perspective view of the cover of FIG. 1, according to the preferred embodiment of the present invention.

With reference to FIG. 1, a protective cover for a guitar 10 is disclosed for protecting the body 21 of a guitar 20 of the type having an upper fin 30 and a lower fin 32. The body 21 of the guitar 20 of the sort presented herein for purposes of this disclosure has a front side 23 joined integrally to a lower side 23*a* by a continuous peripheral sidewall 22. The front side 23 of the body 21, illustrated in FIG. 2 and labeled as "prior art", and the peripheral sidewall 22 are integrally joined at a first peripheral edge 122. The lower side 23*a* of the body 21, illustrated in FIG. 3 and labeled as "prior art", and the peripheral sidewall 22 are integrally joined at a second peripheral edge 124.

The front side 23 of the guitar 20 generally includes a pick guard 24 and is attached to the front side 23 by pick guard screws 25. The body 21 has a neck 26 extending therefrom which terminates into a head stock 27. The head stock 27 is mounted with a plurality of tuning pegs 28 to adjust the tension in the strings 40 of the guitar 20. The neck 26 includes frets 28*a*, inlays 29, and a nut 33, wherein nut 33 is located below the headstock 27.

The body 21 of the guitar 20 further includes a bridge 34, a bridge pickup 35, a middle pickup 36, and a neck pickup 37, each of which being mounted atop the front side 23 thereof. The body 21 may include a volume knob 38, a plurality of tone knobs 39, and an output jack 42, each of which being mounted atop the front side 23 of the body 21. A strap button 44 is installed both along a lower peripheral sidewall 22*a* of the body 21 and along the peripheral sidewall portion 22*b* defining a crest of the upper fin 30. In particular guitar models, an output jack 42*a* may alternatively be installed along the peripheral sidewall 22 of body 21 proximal to the tone knobs 39 in lieu of the output jack 42 being mounted atop the front side 23 of the body 21.

While the guitar 20 illustrated and described herein is more specifically defined as an electric guitar 20, it is to be understood and appreciated that such instrument is presented for exemplary purposes, and that other string musical instruments embodying a substantially similar design, such as an electric bass (not shown), may be readily utilized for carrying out the several purposes of the claims presented in this application.

Referring now to FIG. 1 and more particularly to FIGS. 4-9, a protective cover in accordance with the preferred embodiment, and generally denoted by the reference character 10 is disclosed. The protective cover 10, hereinafter referred to as cover 10, comprises a flexible body 50 adapted to form fit to the contours of the body 21 of the guitar 20. The body 50 is constructed of a flexible, durable material. The body 50, as shown and described herein, is constructed of leather, but while other flexible textile materials having similar properties and functional capabilities as leather may be utilized, leather provides the optimum fabrication material for carrying out the unanticipated and nonobvious functional advantages and features of the present invention, to be described later in greater detail. The cover 10 is also easily foldable to a small volume, thereby facilitating compact storage and transport.

The body 50 comprises an inner surface 51 and an outer surface 51*a*, wherein body 50 includes an anterior region 52 opposite a posterior region 54, and a central region 55 located therebetween. The body 50 further comprises a generally U-shaped configuration and includes a first fin member 70 and a second fin member 74 formed at the anterior region 52 of body 50. The body 50 includes an arcuate-shaped neck 57 integrally bridging the first fin member 70 and second fin member 74. The body 50 tapers inward from a greater transverse width at anterior region 52 to a smaller transverse width at central region 55 forming first 55*a* and second concave portions 55*b* of central region 55, and terminating to a greater transverse width defining a pair of curved edge members 54*a*, 54*b* at posterior region 54. The first concave portion 55*a* and second concave portion 55*b* each defines a nadir 56, 56*a*, respectively.

The body 50 is connected to a peripheral side member 60 by means of a suitable sewing thread. The peripheral side member 60 extends peripherally about the body 50 starting from a position where the neck 57 integrally transitions into the first fin member 70 and continues downward therefrom into a U-shaped configuration until terminating at a position where the neck 57 integrally transitions into the second fin member 74. More specifically, the peripheral side member 60 extends from a first point 58 along a curvature of the neck 57 and extends therefrom along an outer edge of the body 50 at first fin member 70 of anterior region 52, and extending along an outer edge of first concave portion 55*a*, and further extending along an outer edge of the posterior region 54, and extending therefrom along an outer edge of second concave portion 55*b*, and extending along an outer edge of the second fin member 74 and terminating at a second point 59 along a curvature of the neck 57. The peripheral side member 60 has an elasticized bottom edge 62 adapted to allow the cover 10 to form fit to the contours of the guitar body 21 in an intimate, taut manner. The cover 10 is slipped onto the guitar body 21 in a fashion such that the inner surface 51 of cover 10 engages the lower side 23*a* and peripheral sidewall 22 of guitar body 21. More specifically, the cover 10 flexibly stretches and intimately conforms to the outer configuration of the lower side 23*a* and peripheral sidewall 22 of guitar body 21 and further in a manner such that the elasticized bottom edge 62 tightly envelopes the first peripheral edge 122 of guitar body 21 at generatrix 126 (illustrated as a broken line in FIG. 2), and tightly envelopes the second peripheral edge 124 at generatrix 127 (illustrated as a broken line in FIG. 3).

An aperture 80 or circular slit is formed in both the first fin member 70 and the peripheral side member 60 at posterior region 54 to receive the strap button 44 of guitar body 21.

Referring now more specifically to FIGS. 1-2, and FIGS. 4-6, the body 50 further comprises a fastener 90 in the form of a strap 92 adapted to aid in securely holding the cover 10 onto the guitar 20. The strap 92 has a lower end 93 suitably attached to an inner surface of the peripheral side member 60 directly above the nadir 56*a* of second concave portion 55*b*. Strap 92 has an upper end 94 removably attachable to the outer surface of the peripheral side member 60 directly above the nadir 56 of first concave portion 55*a*. In accordance with the preferred embodiment, the strap 92 is removably attachable to the peripheral side member 60 above the nadir 56 of first concave portion 55*a* via a hook-and-loop fastener 95. The upper end 94 of strap 92 includes the hook portion 95*a* of hook-and-loop fastener 95, and the loop portion 95*b* of hook-and-loop fastener 95 is suitably attached or adhered to the outer surface of the peripheral side member 60 directly above the nadir 56 of first concave portion 55*a*. In a fastened position, the strap 92 is intimately engaged in a taut, snug manner against the front side 23 of the body 21 of guitar 20, between the neck pickup 37 and middle pickup 36, and below guitar strings 40 thereof. When the cover 10 is slipped onto and protecting guitar body 21, the strap 92 is designed, configured, and fastened such that the strap 92 is physically isolated from contact with guitar strings 40 and control knobs 38 and 39, thereby providing a guitar player with unobstructed access to and use of the control knobs 38 and 39 and guitar strings 40 during the playing of the guitar 20.

While the a hook-and-loop fastener 95 is the preferable attachment means for removably attaching strap 92 to the outer surface of the peripheral side member 60, other attachment means, such as a snap fastener, can be used.

2. Operation of the Preferred Embodiment

To use the present invention, user slips the cover 10 onto the guitar body 21 in a fashion such that the inner surface 51 of cover 10 engages the lower side 23*a* and peripheral sidewall 22 of guitar body 21. In so doing, user slips the first fin member 70 over the upper fin 30 of body 50, allowing the strap button 44 at crest of the upper fin 30 to insert through the aperture 80 defined in first fin member 70, and slips the second fin member 74 over the lower fin 32 of guitar body 21. Next, user stretches and places the cover 10 in an operative position along the first peripheral edge 122 of guitar body 21 in a manner such that the elasticized bottom edge 62 of cover 50 tightly envelopes the first peripheral edge 122 of guitar body 21 along generatrix 126, and tightly envelopes the second peripheral edge 124 of guitar body 21 along generatrix 127. User then inserts the strap button 44 at the lower peripheral sidewall 22*a* of the guitar body 21 through the aperture 80 defined in the peripheral side member 60 of body 50 along the posterior region 54 thereof. Finally, user removably attaches the strap 92 to the peripheral side member 60 above the nadir 56 of the first concave portion 55*a* in such a manner whereby the strap 92 is intimately engaged in a taut, snug manner against the front side 23 of the guitar body 21, between the neck pickup 37 and middle pickup 36, and below guitar strings 40 thereof. In this fastened arrangement, the strap 92 is physically isolated from contact with guitar strings 40 and control knobs 38 and 39, thereby providing a guitar player with unobstructed access to and use of the control knobs 38 and 39 and guitar strings 40 during the playing of the guitar 20.

It is envisioned that the various embodiments, as separately disclosed, are interchangeable in various aspects, so that elements of one embodiment may be incorporated into one or more of the other embodiments, and that specific positioning of individual elements may necessitate other arrangements not specifically disclosed to accommodate performance requirements or spatial considerations.

It is to be understood that the embodiments and claims are not limited in its application to the details of construction and arrangement of the components set forth in the description and illustrated in the drawings. Rather, the description and the drawings provide examples of the embodiments envisioned, but the claims are limited to the specific embodiments. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the U.S. Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be broadly limited only by the following Claims.

What is claimed is:

1. A protective cover for a guitar having a body with an upper fin and a lower fin, said cover comprising:

a flexible body, said flexible body comprises a U-shaped configuration, said flexible body form fits to contours of the guitar body, said flexible body is constructed of a flexible, durable material, said flexible body is easily foldable to a small volume, thereby facilitating compact storage and transport, said flexible body includes an inner surface and an outer surface, wherein said flexible body includes an anterior region opposite a posterior region, and a central region located therebetween, said posterior region having an aperture formed therein to receive a strap button of the guitar body, said flexible body has a first fin member and a second fin member formed at said anterior region, said first fin member having an aperture formed therein to receive a strap button of the guitar body, said flexible body includes an arcuate-shaped neck integrally bridging said first fin member and said second fin member, said flexible body tapers inward from a greater transverse width at said anterior region to a smaller transverse width at said central region forming a first concave portion and a second concave portion, and said flexible body terminates to a greater transverse width defining a pair of curved edge members at said posterior region;

a peripheral side member, said peripheral side member is connected to said flexible body; and a fastener, said fastener securely holds said cover onto guitar.

2. The protective cover of claim 1, wherein said first concave portion defines a nadir, and wherein said second concave portion defines a nadir.

3. The protective cover of claim 1, wherein said peripheral side member extends from a first point along a curvature of said neck and extends therefrom along an outer edge of said flexible body at said first fin member of said anterior region, and extending along an outer edge of said first concave portion, and further extending along an outer edge of said posterior region, and extending therefrom along an outer edge of said second concave portion, and extending along an outer edge of said second fin member and terminating at a second point along a curvature of said neck.

4. The protective cover of claim 3, wherein said peripheral side member has an elasticized bottom edge.

5. The protective cover of claim 4, wherein said elasticized bottom edge facilitates a form fit by said cover to the contours of the guitar body in an intimate, taut manner, wherein said cover flexibly stretches and intimately conforms to an outer configuration of a lower side and a peripheral sidewall of the guitar body and further in a manner such that said elasticized bottom edge tightly envelopes a first peripheral edge of the guitar body at a first generatrix, and tightly envelopes a second peripheral edge of the guitar body at a second generatrix.

6. The protective cover of claim 1, wherein said fastener is defined as a strap, said strap has a lower end suitably attached to an inner surface of said peripheral side member directly above a nadir of said second concave portion.

7. The protective cover of claim 6, wherein said strap has an upper end removably attachable to an outer surface of said peripheral side member directly above a nadir of said first concave portion.

8. The protective cover of claim 7, wherein said strap is removably attachable to said peripheral side member above the nadir of said first concave portion via a hook-and-loop fastener so as to be in a removably fastened position, said upper end of said strap includes a hook portion of said hook-and-loop fastener, and said peripheral side member includes a loop portion of said hook-and-loop fastener suitably attached or adhered to said outer surface of said peripheral side member directly above the nadir of said first concave portion, and whereupon placement of said strap in said removably fastened position, said strap is intimately engaged in a taut, snug manner against a front side of the guitar body, between a neck pickup and a middle pickup, and below guitar strings of the guitar body, and wherein said cover is slipped in an operative, protective position onto the guitar body, said strap is configured and fastened such that said strap is physically isolated from contact with the guitar strings and control knobs of the guitar body, thereby providing unobstructed access to and use of the control knobs and the guitar strings during playing of the guitar.

9. The protective cover of claim 1, wherein said flexible body is constructed of leather.

* * * * *